US007117858B2

(12) United States Patent
Nonaka et al.

(10) Patent No.: US 7,117,858 B2
(45) Date of Patent: Oct. 10, 2006

(54) OIL SEPARATOR COMBINED WITH CYLINDER HEAD COVER

(75) Inventors: Atsushi Nonaka, Saitama (JP); Terumoto Mochizuki, Saitama (JP)

(73) Assignee: Mahle Filter Systems Japan Corporation, Tokyo (JP)

( * ) Notice: Subject to any disclaimer, the term of this patent is extended or adjusted under 35 U.S.C. 154(b) by 0 days.

(21) Appl. No.: 10/963,743

(22) Filed: Oct. 14, 2004

(65) Prior Publication Data

US 2005/0092267 A1 May 5, 2005

(30) Foreign Application Priority Data

Oct. 15, 2003 (JP) ..... 2003-354481

(51) Int. Cl.
*F02M 25/26* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,607,604 A * 8/1986 Kanoh et al. ..... 123/572
4,723,529 A * 2/1988 Yokoi et al. ..... 123/573
5,129,371 A * 7/1992 Rosalik, Jr. ..... 123/90.38
5,746,168 A * 5/1998 Lochbrunner et al. ... 123/90.38
5,957,100 A * 9/1999 Frohwerk et al. ..... 123/90.38
6,029,638 A * 2/2000 Funai et al. ..... 123/572
6,412,478 B1 * 7/2002 Ruehlow et al. ..... 123/572
6,443,136 B1 * 9/2002 Suganami et al. ..... 123/572
6,530,367 B1 * 3/2003 Akiwa et al. ..... 123/572

FOREIGN PATENT DOCUMENTS

JP 7-243317 A 9/1995
JP 2000-45750 A 2/2000

* cited by examiner

*Primary Examiner*—Marguerite McMahon
(74) *Attorney, Agent, or Firm*—Foley & Lardner LLP

(57) ABSTRACT

An oil separator provided in combination with a cylinder head cover of an internal combustion engine. The oil separator includes a separator cover fixed to an inner surface of the cylinder head cover defining a space extending in a first direction perpendicular to axis of a camshaft in plan, between the separator cover and the cylinder head cover. The separator cover has an opening through which the space is opened to a valve operating chamber. A partition wall is provided to define in the space an inlet-side separator chamber and an outlet-side separator. The partition wall extends in a second direction parallel with the axis of the camshaft and being formed with a plurality of fine passages. Additionally, a plurality of projection walls project from a part of the inner surface of the cylinder head cover which faces the valve operating chamber through the opening.

7 Claims, 5 Drawing Sheets

OIL SEPARATOR COMBINED WITH CYLINDER HEAD COVER

BACKGROUND OF THE INVENTION

This invention relates to improvements in an oil separator provided in combination with a cylinder head cover of an internal combustion engine to separate oil mist in blow-by gas to be discharged out of the engine through the cylinder head cover.

As is well known, in an internal combustion engine of an automotive vehicle, blow-by gas containing unburnt gas component leaked into a crankcase from combustion chambers of the engine is again introduced or recirculated into the combustion chambers through an engine air intake system, together with fresh taken in from the outside of the engine. In such recirculation of blow-by gas, blow-by gas flowing through the crankcase contains oil mist of lubricating oil. In order to prevent oil mist from being carried to the engine intake system, in general, an oil separator is provided in combination of a cylinder head cover as a single unit so that the blow-by gas is taken out from the engine after oil mist is separated from blow-by gas by the oil separator, as disclosed in Japanese Patent Provisional Publication Nos. 2000-45750 and 7-243317. In general, two blow-by gas paths are connected to the cylinder head cover, in which fresh air is introduced through one of the two blow-by gas paths under a normal engine operating condition while blow-by gas flows through both the two blow-by gas paths under a high engine load operating condition. The cylinder head cover is provided with two oil separators which are respectively used for the two blow-by gas paths.

Many oil separators provided in combination with the cylinder head cover have been proposed. In an arrangement of Patent Provisional Publication No. 2000-45750, an inner plate having a plurality of small holes for oil separation is horizontally disposed, in which blow-by gas passed through the small holes strike against projection portions formed at a ceiling surface. Accordingly, oil droplets separated are spread on the upper surface of the inner plate thereby clogging the small holes. This lowers an oil separation performance of the oil separator.

In the arrangement of Patent Provisional Publication No. 7-243317, a cover-like inlet member is disposed at the bottom plane of an inlet opening which is open to the upper side of a camshaft in order to prevent oil droplets raised up by the camshaft from directly entering the inlet opening. This inlet member increases the whole height of the cylinder head cover by an amount corresponding to the inlet member.

SUMMARY OF THE INVENTION

It is, therefore, an object of the present invention is to provide an improved oil separator provided in combination with a cylinder head cover of an internal combustion engine, which can effectively overcome drawbacks encountered in conventional oil separators provided in combination with a cylinder head cover.

Another object of the present invention is to provide an improved oil separator provided in combination with a cylinder head cover of an internal combustion engine, which makes it possible to reduce the whole height of the cylinder head cover, while its fine passages for separation of oil mist can be effectively prevented from being clogged with separated oil mist so as to provide a stable oil separation performance.

A further object of the present invention is to provide an improved oil separator provided in combination with a cylinder head cover of an internal combustion engine, whose vertical dimension can be minimized, while a partition wall formed with fine passages is vertically disposed.

An aspect of the present invention resides in an oil separator provided in combination with a cylinder head cover of an internal combustion engine to separate oil mist from blow-by gas to be discharged out through the cylinder head cover. The oil separator comprises a separator cover fixed to an inner surface of the cylinder head cover defining a space extending in a first direction perpendicular to axis of a camshaft in plan, between the separator cover and the cylinder head cover. The separator cover includes a first end section having an opening through which the space is opened to a valve operating chamber. A partition wall is provided to define in the space an inlet-side separator chamber and an outlet-side separator chamber which are located on opposite sides of the partition wall. The inlet-side separator chamber is located adjacent the opening. The outlet-side separator chamber is defined by a second end section of the separator cover. The second end section is opposite to the first end section in the first direction. The partition wall extends in a second direction parallel with the axis of the camshaft and being formed with a plurality of fine passages which pass through the partition wall. Additionally, a plurality of projection walls project from a part of the inner surface of the cylinder head cover which faces the valve operating chamber through the opening. The projection walls project toward the valve operating chamber and extending in the second direction, the projection walls being located separate from each other.

BRIEF DESCRIPTION OF THE DRAWINGS

In the drawings, like reference numerals designate like parts and elements throughout all the figures.

DETAILED DESCRIPTION OF THE INVENTION

Figure 1:
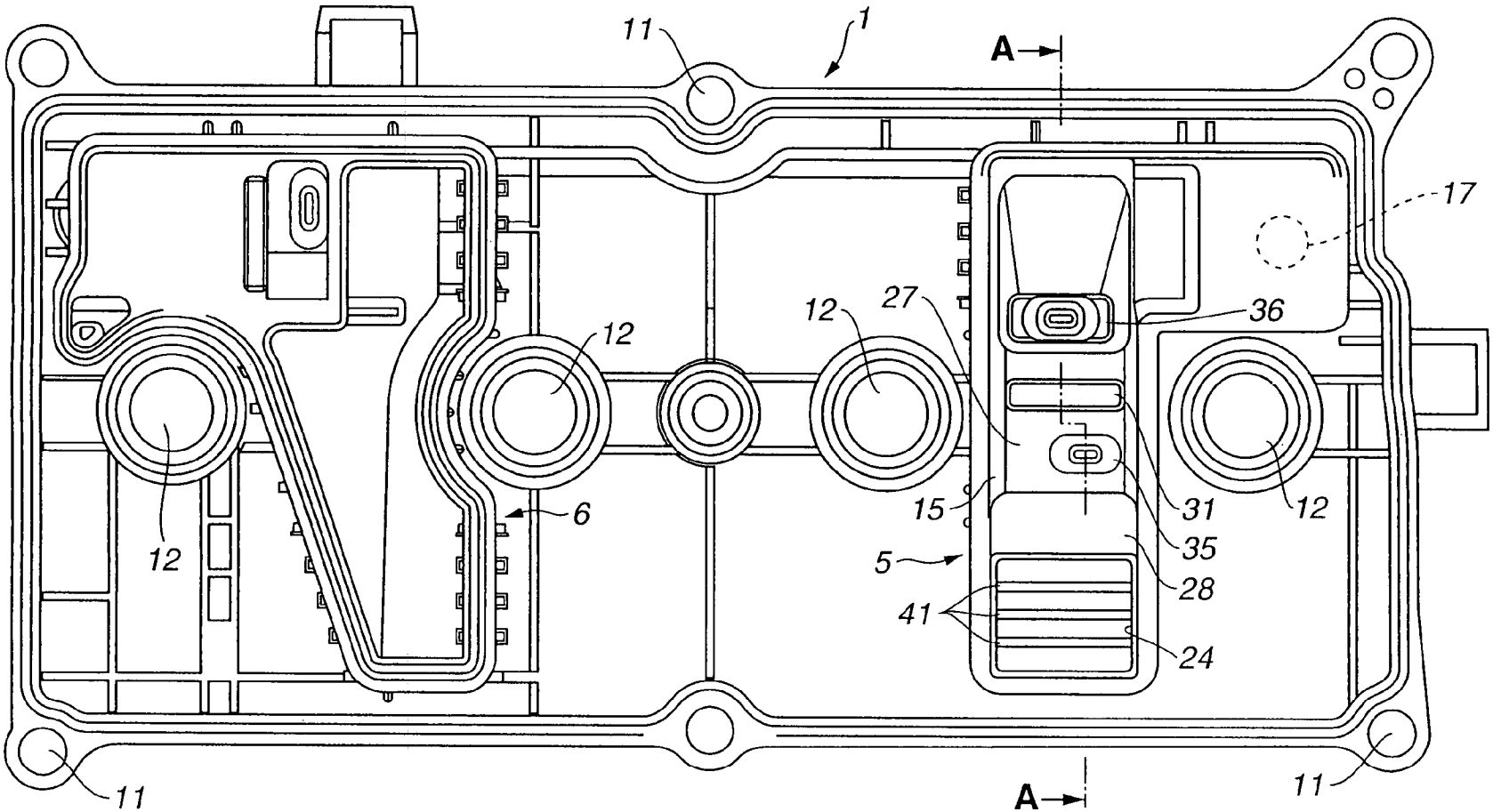
FIG. 1 is a bottom view of a cylinder head cover of an internal combustion engine, provided with an embodiment of an oil separator according to the present invention.
Figure 2:
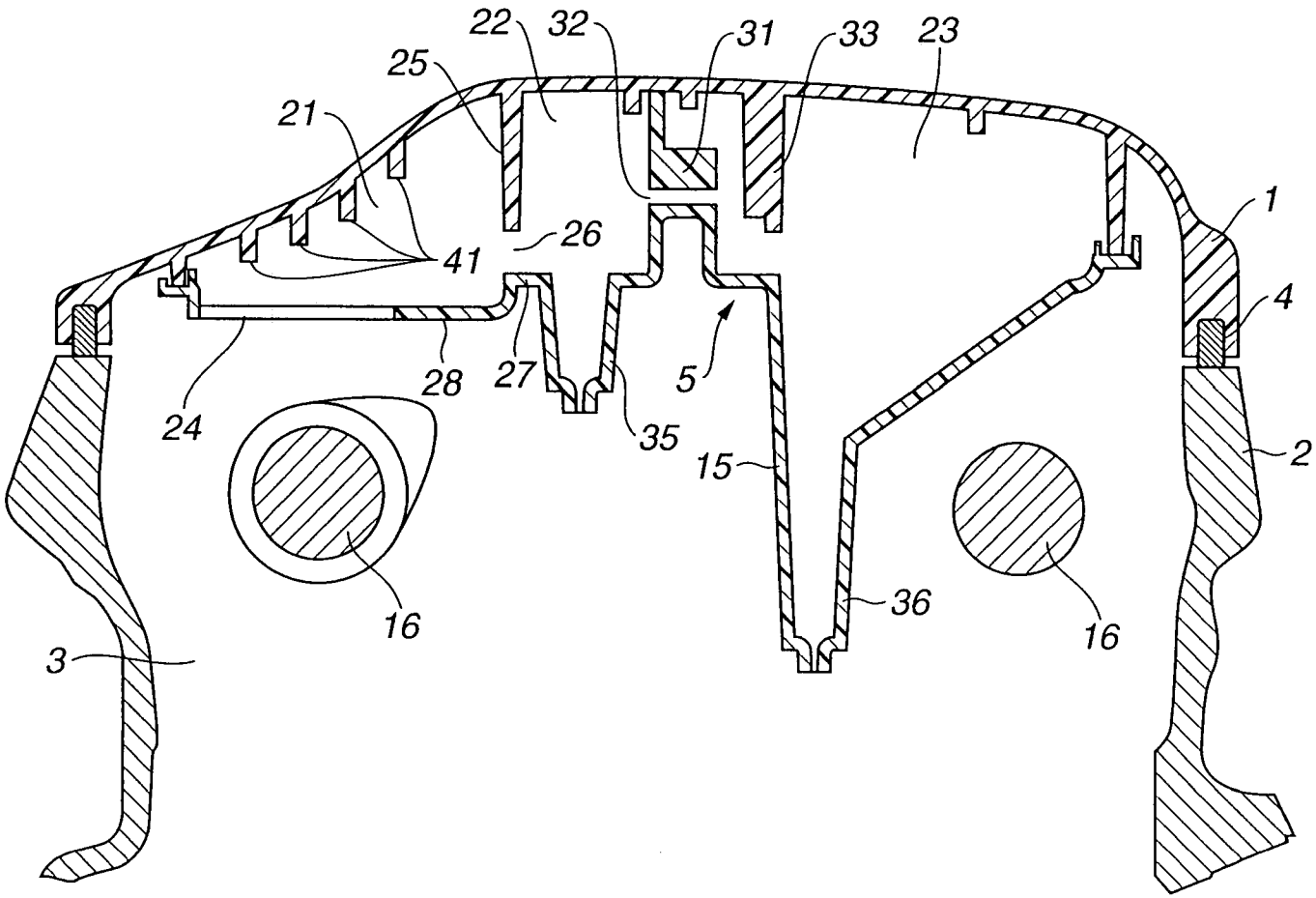
FIG. 2 is a vertical sectional view of the oil separator of FIG. 1 in the state of being installed to a cylinder head of the internal combustion engine.

Referring now to FIGS. 1 and 2, an embodiment of an oil separator according to the present invention is illustrated to be provided in combination with a cylinder head cover 1 of an internal combustion engine. The internal combustion engine is of the in-line 4-cylinder type. FIG. 1 shows an inside arrangement of the cylinder head cover 1. This cylinder head cover 1 is installed together with a seal member 4 on a cylinder head 2 of the internal combustion engine as shown in FIG. 2, and defines a valve operating chamber 3 for accommodating a valve operating mechanism (not shown) of a so-called DOHC type. The valve operating chamber 3 is in communication with a crankcase of the side of a cylinder block (not shown). Blow-by gas flows from the crankcase to the valve operating chamber 3 and then is guided to the outside of the engine through a blow-by gas passage (not shown) connected to the cylinder head cover 1.

The cylinder head cover 1 is formed of plastic such as polyamide and includes a main body (not identified) which is formed generally dome-shaped. The cylinder head cover 1 is provided with a peripheral section formed with six bolt insertion holes 11 in which bolts (not shown) are respectively inserted for connection of the cylinder head cover with the cylinder head 2. Additionally, the cylinder head cover 1 is formed with four spark plug holes 12 which are located at positions which respectively correspond to centers of cylinder bores of Nos. 1 to 4 engine cylinders (not shown). Spark plugs (not shown) are fixedly disposed respectively in the spark plug holes 12. Nos. 1 and 4 engine cylinders are located opposite to each other, in which Nos. 2 and 3 engine cylinders are located between the Nos. 1 and 4 engine cylinders. The oil separator 5 of the present invention is located between the spark plug hole positioned corresponding to No. 1 engine cylinder and the spark plug hole positioned corresponding to No. 2 engine cylinder. Specifically, the oil separator 5 includes a separator cover 15 which is formed of plastic such as polyamide and fabricated independently from the cylinder head cover 1. The separator cover 15 is installed to the inside surface at the top section and generally extends in a lateral direction of the cylinder head cover 1 or in a direction perpendicular to the axes of camshafts 16 in plan or in FIG. 1. More specifically, as shown in FIG. 1, the separator cover 15 is generally L-shaped in plan, in which a main body section of the separator cover 15 extends in the lateral direction of the cylinder head cover 1 while an auxiliary body section extends in a direction parallel to the axes of the camshafts 16. The auxiliary body section of the separator cover 15 extends to such a position as to cover a blow-gas discharge opening 17 formed in the main body of the cylinder head cover 1. A pipe (not shown) is connected to the blow-gas discharge opening 17. The main body section and the auxiliary body section of the separator cover 15 define respectively a main chamber and an auxiliary chamber. The peripheral section of the separator cover 15 is welded to a projection wall (not identified) projected from the inside surface of the main body of the cylinder head cover 1 and extending along a peripheral section of the separator cover 15.

Figure 3:
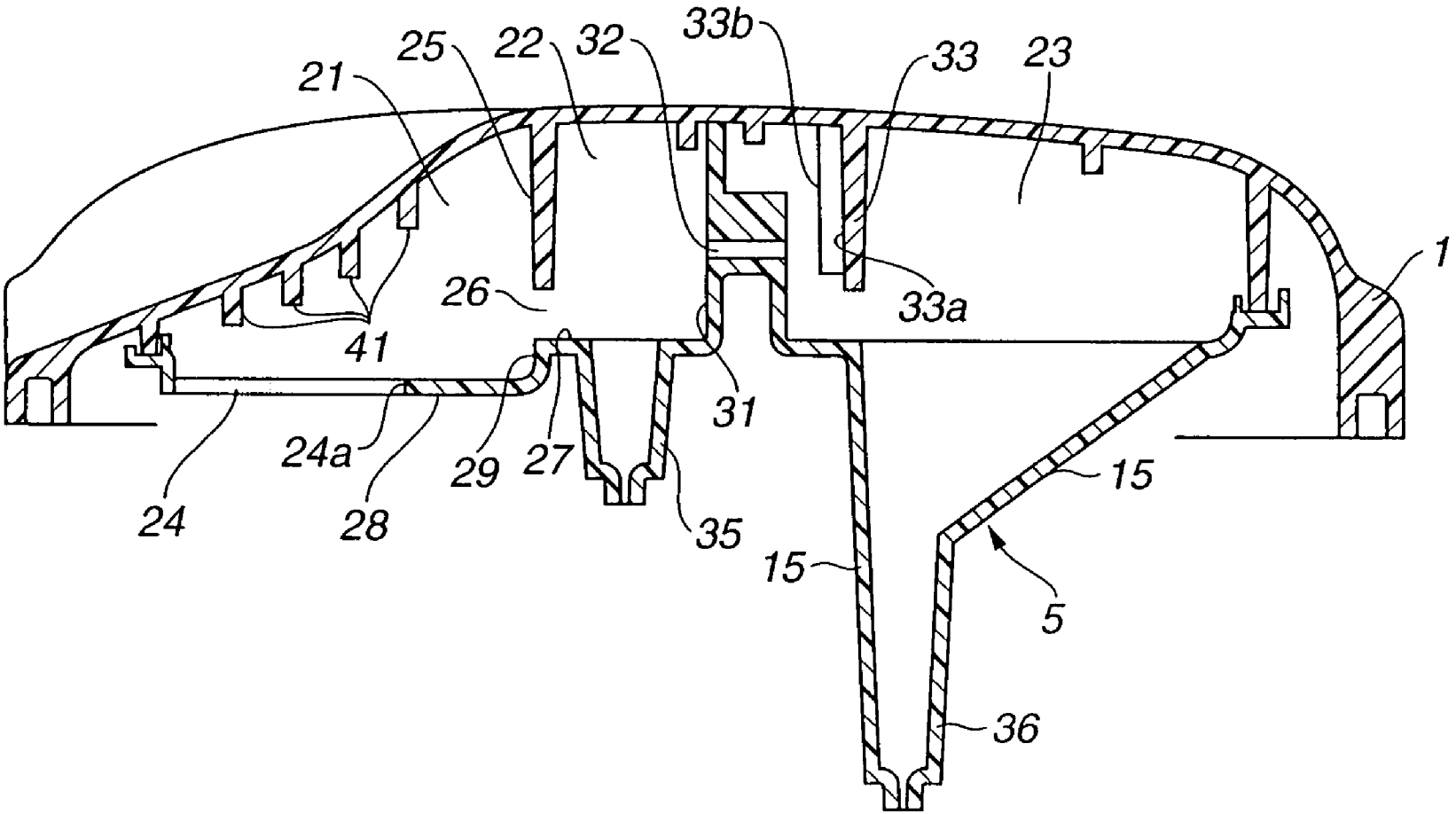
FIG. 3 is a vertical sectional view of the oil separator of FIG. 1 taken in the direction of arrows substantially along the line A—A of FIG. 1.

As shown in FIG. 3 which is a cross-section taken along a line A—A of FIG. 1, the inside (or the main chamber) of the oil separator 5 constructed of the separator cover 15 and the main body of the cylinder head cover 1 includes an inlet chamber 21, an inlet-side separator chamber 22 and an outlet-side separator chamber 23. The inlet chamber 21 is located at one end side of the extending main chamber of the oil separator 5. The outlet-side separator chamber 23 is located at the other end side of the extending main chamber of the oil separator 5. The inlet-side separator chamber 22 is located between the inlet chamber 21 and the outlet-side separator chamber 23. An end section of the separator cover 15 defining the inlet chamber 21 is formed with a rectangular (in plan) opening 24 through which the inlet chamber 21 is open to the valve operating chamber 3. The opening 24 is defined by a rectangular (in plan) inner peripheral edge 24*a* of the separator cover 15. While the rectangular opening 24 has been shown leaving a generally frame-like peripheral portion, it will be understood that the opening may be formed by cut out a part of the end section of the separator 15 defining the inlet chamber 21.

The inlet chamber 21 and the inlet-side separator chamber 22 is separated from each other by a partition wall 25 which is projected downward from the inside surface (ceiling) of the main body of the cylinder head cover 1. The lower end of the partition wall 25 is separate from a separator chamber bottom wall 27 forming part of the separator cover 15 and defining the inlet-side separator chamber 22, thereby forming a slit-like gas inlet 26. The partition wall 25 extends in a direction parallel with the axes of the camshafts 16. An inlet chamber bottom wall 28 is left between the inner peripheral edge 24*a* for the opening 24 and a gas inlet portion (not identified) of the separator chamber bottom wall 27 defining the gas inlet 26. The inlet chamber bottom wall 28 has a width (dimension in the direction perpendicular to the axes of the camshafts 16 in plan) of about half of that of the opening 24. In other words, about ⅓ (in area) of the bottom part (located adjacent the above-mentioned gas inlet portion) of the inlet chamber 21 is covered with the inlet chamber bottom wall 28, while the remaining about ⅔ (in area) of the bottom part of the inlet chamber 21 opens as the opening 24. The level or height position of the inlet chamber bottom wall 28 is slightly lower than that of the separator chamber bottom wall 27, thereby forming a step portion 29 between the above-mentioned gas inlet portion of the separator chamber bottom wall 27 and the inlet chamber bottom wall 28. One of the camshafts 16 are located under the opening 24, in which the length (vertical dimension) of the partition wall 25 and the length (horizontal dimension) of the inlet chamber bottom wall 28 (i.e., location of a part of the inner peripheral edge 24*a* of inlet chamber bottom wall 28) are set to prevent oil droplets tangentially scattered from the rotating camshaft 16 from directly entering the gas inlet 26.

The inlet-side separator chamber 22 and the outlet-side separator chamber 23 are separated from each other by a partition wall 31 forming part of the separator cover 15. The partition wall 31 extends laterally or in a direction parallel with the axes of the camshafts 16, and extends upwardly to reach the inside surface of the main body of the cylinder head cover 1. The partition wall 31 is formed with a plurality of fine passages 32 which extend horizontally or in a direction perpendicular to the axes of the camshafts 16 in plan. Each fine passage 32 passes through the partition wall 31. It will be understood that the partition wall 31 is formed relatively thick in order to ensure a certain length of the fine passages 32. While the partition wall 31 has been shown and described as being integrally formed as a part of the separator cover 15, it will be understood that the partition wall 31 is not limited to have such a structure, and therefore the partition wall 31 may be formed as a separate part independent from the separator cover 15.

The partition wall 31 formed with the fine passages 32 serves as a kind of filter so as to accomplish separation of oil mist. An uneven plate 33 is formed integral with the cylinder head cover 1 and extends downward. The uneven plate 33 is located opposite to the partition wall 31 so in such a manner as to be slightly separate from the partition wall 3, so that it is generally parallel with the partition wall 31. The uneven plate 33 is formed at a surface facing the partition wall 31 with a plurality of linear grooves 33*a* and linear projections 33*b* which extend vertically or in a direction perpendicular to the axes of the camshafts 16, in a plane perpendicular to the axes of the camshafts 16. Each of the liner grooves 33*a* and each of the linear projections 33*b* are located alternately so that a linear projection 33*b* is located between adjacent two linear grooves 33*a*. Accordingly, flow of blow-by gas passed through the fine passages 32 then strike against the uneven surface of the uneven plate 33. More specifically, a part of blow-by gas strikes against the top surfaces of the linear projections 33*b* upon being diffused, while the remaining part advances into the linear grooves 33*a* and then strikes against the bottom surface of each liner groove 33*a* and the side surfaces of the linear grooves 33*a* a plurality of times, in which oil mist is separated every strikes. Blow-by gas struck against the linear grooves 33*a* and the linear projections 33*b* moves upward or downward along the linear grooves 33*a* and projections 33*b*, and then flows into the outlet-side separator chamber 23.

A drain pipe 35 is formed integral with the separator chamber bottom wall 27 and extends downward in order to drain oil droplets separated from blow-by gas to the side of the valve operating chamber 3. The inside of the drain pipe 35 is contiguous with the bottom part of the inlet-side separator chamber 22. The drain pipe 35 is generally in the shape of a flattened cylinder as seen from FIG. 1, and extends into the valve operating chamber 3. The drain pipe 35 has a tip end section formed with a small discharge opening (not identified) through which the separated oil droplets are discharged into the valve operating chamber 3. Similarly, a drain pipe 36 is formed integral with a separator chamber bottom wall (of the separator cover 15) defining the outlet-side separator chamber 23 and extends downward in order to drain oil droplets separated from blow-by gas to the side of the valve operating chamber 3. The outlet-side separator chamber 23 is formed generally L-shaped in plan and extends to the side of the No. 1 engine cylinder as shown in FIG. 1. The blow-by gas discharge opening 17 formed in the cylinder head cover 1 is in communication with the outlet-side separator chamber 23.

A plurality of projection walls 41 are formed at a part (defining the inlet chamber 21) of the inside surface or ceiling of the main body of the cylinder head cover 1 and extend downward or in a direction parallel with the axes of the camshafts 16. The projection walls 41 are arranged parallel with each other and spaced from each other with a suitable distance between the adjacent projection walls 41. In this embodiment, four projection walls 41 are formed at equal intervals in a part of the inside surface of the main body of the cylinder head cover 1 which part corresponds to the opening 24. The part of the inside surface of the main body of the cylinder head cover 1 is inclined in a direction perpendicular to the axes of the camshafts 16 on the plane perpendicular to the axes of the camshafts 16, thereby forming inclined inner and outer surface of the main body of the cylinder head cover 1. The inclined outer surface of the main body of the cylinder head cover 1 is provided to avoid the interference with an EGR valve (not shown) of an exhaust system of the engine. In other words, a space above the inclined outer surface of the main body of the cylinder head cover 1 is for the EGR valve. Thus, the main body of the cylinder head cover 1 is formed partly depressed to provide the space for the EGR valve.

With the oil separator 5 arranged as discussed above, when blow-by gas within the valve operating chamber 3 moves toward the blow-by gas discharge opening 17, it first goes to the inlet chamber 21 through the opening 24 and then passes through the slit-like gas inlet 26 to enter the inlet-side separator chamber 22. As will be understood, even during a time where blow-by gas flows from the inlet chamber 21 to the inlet-side separator chamber 22, a certain amount of oil mist can be separated to form oil droplets. Then, oil mist is effectively separated upon passing of blow-gas through the fine passages 32, and further separated upon striking of blow-by gas against the uneven surface of the uneven plate 33 after passing of blow-gas through the fine passages 32, thereby forming oil droplets at the bottom part of the inlet-side and outlet-side separator chambers 21, 23. Additionally, since the volume of the outlet-side separator chamber 23 is considerably large, the flow rate of blow-by gas lowers so that oil mist is separated here by its own weight thereby forming oil droplets. The oil droplets are collected at the bottom parts of the respective inlet-side and outlet-side separator chambers 21, 23, and then drop into the valve operating chamber 3 through the drain pipes 35, 36. Here, in the thus arranged oil separator 5, blow-by gas basically flows along the width direction of the cylinder head cover 1 or the lateral direction perpendicular to the axes of the camshafts 16, and therefore a sufficiently long passage for blow-by gas can be ensured in a region from the inlet chamber 21 to the blow-by gas discharge opening 17, thereby providing a good oil separation performance. Oil droplets adhered to the vertically disposed partition wall 31 smoothly flows down along the surface of the partition wall 31, thereby preventing the fine passages 32 from being clogged with oil droplets thus providing a stable oil separation performance.

Additionally, with rotation of the camshaft 16 located under the opening 24 of the separator cover 15, oil droplets are scattered in a tangential direction from the camshaft 16. The oil droplets will strike against and be reflected on the inner surface or ceiling defining the inlet chamber 21; however, the oil droplets can be prevented from directly entering the gas inlet 26 upon being interrupted with the projection walls 41. Particularly in case that the inner surface or ceiling defining the inlet chamber 21 is inclined, there is the fear that oil droplets moved upward to the ceiling are reflected on the ceiling toward the side of the gas inlet 26 if no projection wall 41 is provided. According to this embodiment, the projection walls 41 are parallelly arranged so that reflected oil droplets can be securely prevented from entering the gas inlet 26. Oil droplets struck and adhered to the projection walls 41 gradually grow to large oil droplets and drop from the projection walls 41 into the valve operating chamber 3 by its own weight.

Thus, according to this embodiment, as shown in FIG. 2, it is possible to locate the opening 24 to be relatively close to the upper side of the camshaft 16, making it unnecessary to use a cover or the like for covering the under side of the opening 24. This not only makes the cylinder head cover 1 itself small-sized but also further lowers the level of the upper surface of the cylinder head cover 1 assembled in the internal combustion engine.

Furthermore, according to this embodiment, the oil separator 5 is constituted of two members, i.e., the cylinder head cover 1 and the separator cover 15 which respectively molded with plastics, thereby facilitating assembly of the oil separator 5 while lowering the production cost of the oil separator 15.

As discussed above, two (first and second) blow-by gas paths are required for recirculation of blow-by gas into the engine cylinders, in which fresh air is introduced into the engine cylinders through one (first) blow-by gas path in a low and medium load engine operating range of the engine. The above oil separator 5 is provided for the first blow-by gas path which serves also as a fresh air introduction passage for introducing fresh air into the engine cylinders. As shown in FIG. 1, another oil separator 6 is provided between the spark plug hole 12 corresponding to the No. 3 engine cylinder and the spark plug hole 12 corresponding to the No.

4 engine cylinder. A second blow-by gas path provided with a so-called PCV valve is connected to this oil separator 6.

Figure 4:
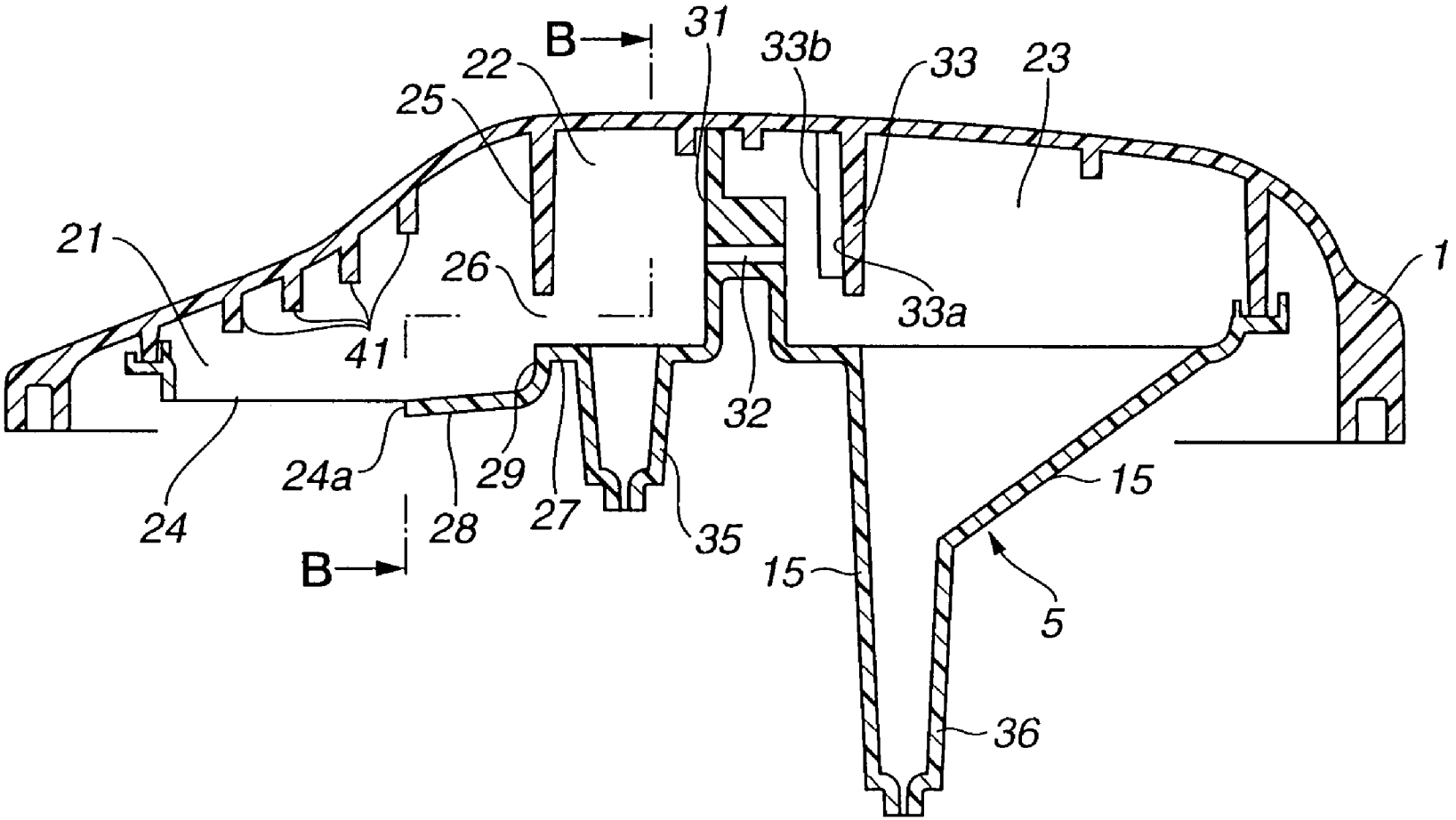
FIG. 4 is a vertical sectional view similar to FIG. 3 but showing another embodiment of the oil separator according to the present invention.
Figure 5:
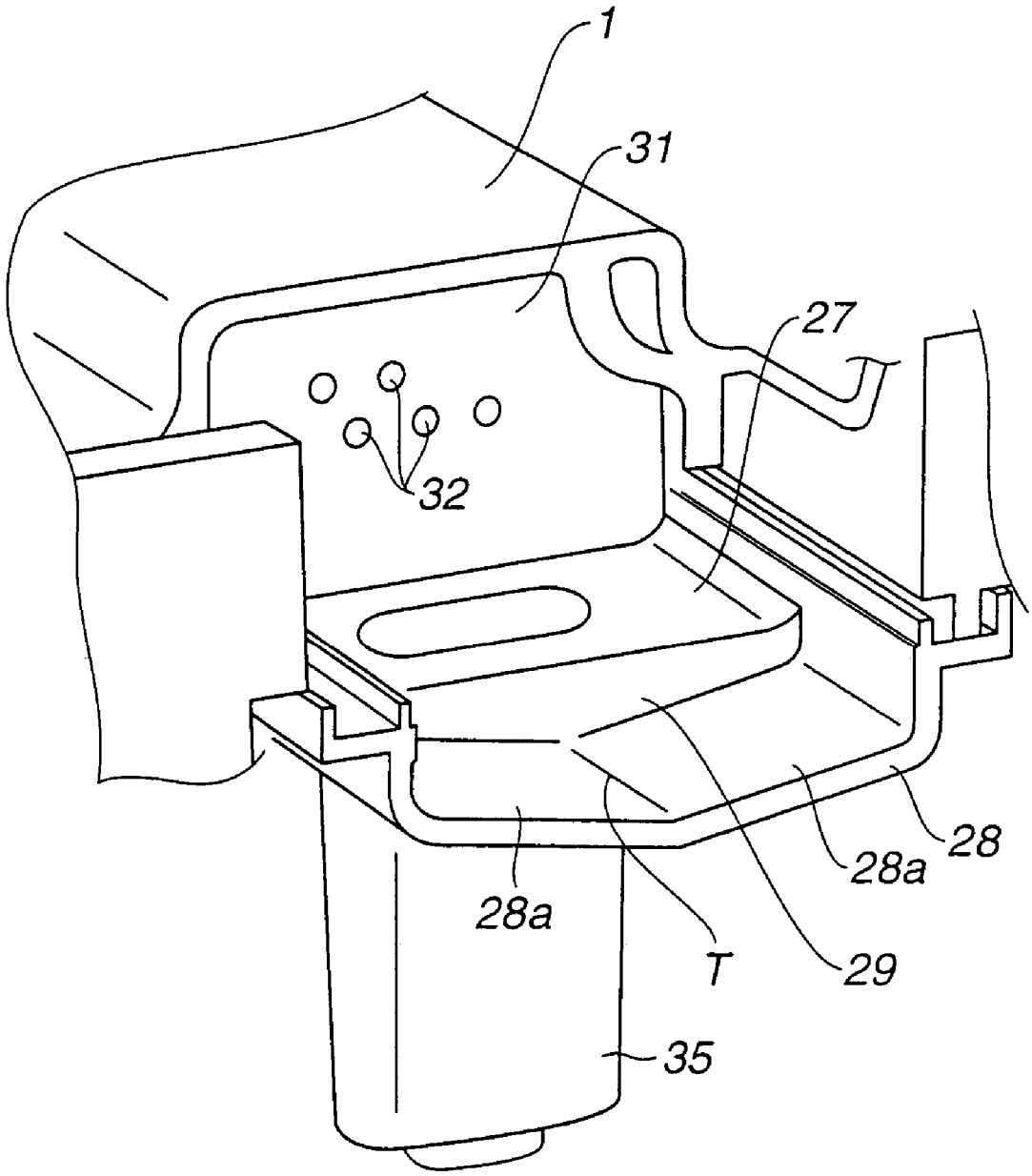
FIG. 5 is a fragmentary perspective view of a part of the oil separator of FIG. 4, cutout in the direction of arrows substantially along the line B—B of FIG. 4.

FIGS. 4 and 5 illustrate another embodiment of the oil separator according to the present invention, similar to the above embodiment of FIGS. 1 to 3 except for being partially modified.

In this embodiment, the inlet chamber bottom wall 28 adjacent the opening 24 of the separator cover 15 does not form a horizontal surface, and forms an inclined surface which is low in level at the side of the opening 24 as compared with at the opposite side. More specifically, as clearly shown in FIG. 5, the inlet chamber bottom wall 28 includes first and second rectangular plate-like sections which are integrally connected to each other to form an upper surface which is generally V-shaped in cross-section so that a trough line T is formed between the first and second rectangular plate-like sections. The trough line T gradually lowers in level in a direction toward the opening 24. As same as in the above embodiment of FIGS. 1 to 3, the step portion 29 is provided between the gas inlet portion of the separator chamber bottom wall 27 and the inlet chamber bottom wall 28. FIG. 5 is a fragmentary perspective view of a part of the oil separator 5 combined with the cylinder head cover 1, cutout generally along the line B—B of FIG. 4 for the purpose of facilitating understanding of the oil separator of this embodiment.

With this arrangement, for example, in case that oil mist strikes against the ceiling of the inlet chamber 21 and drops as oil droplets on the inlet chamber bottom wall 28, the oil droplets tend to readily flow down along the inclined surface of the inlet chamber bottom wall 28, thereby preventing the oil droplets from entering the inlet-side separator chamber 22 through the gas inlet 26. Particularly, oil droplets on the inlet chamber bottom wall 28 is liable to be pushed toward the gas inlet 26 under the action of blow-by gas flowing from the opening 24 toward the gas inlet 26. However, since the step section 29 exists between the inlet chamber bottom wall 28 and the gas inlet 26, and therefore the oil droplets can be securely dammed up so that they flow down along the inclined surface of the inlet chamber bottom wall 28 upon the oil droplets growing into somewhat large oil droplets.

As appreciated from the above, according to the present invention, it is unnecessary to provide a separate cover member or the like below the opening 24 of the separator cover so that the opening 24 is open to the lower side as it is. Consequently, the vertical dimension of the oil separator can be minimized thereby reducing the whole height of the cylinder head cover. Additionally, blow-by gas passes in a lateral direction through the fine passages formed in the vertically disposed partition wall, and therefore the fine passages of the partition wall can be prevented from being clogged with separated oil droplets thereby obtaining a stable oil separation performance.

The entire contents of Japanese Patent Application P2003-354481 (filed Oct. 15, 2003) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. An oil separator provided in combination with a cylinder head cover of an internal combustion engine to separate oil mist from blow-by gas to be discharged out through the cylinder head cover, the oil separator comprising:

a separator cover fixed to an inner surface of the cylinder head cover defining a space extending in a first direction perpendicular to axis of a camshaft in plan, between the separator cover and the cylinder head cover, the separator cover including a first end section having an opening through which the space is opened to a valve operating chamber;

a partition wall defining in the space an inlet-side separator chamber and an outlet-side separator chamber which are located on opposite sides of the partition wall, the inlet-side separator chamber being located adjacent the opening, the outlet-side separator chamber being defined by a second end section of the separator cover, the second end section being opposite to the first end section in the first direction, the partition wall extending in a second direction parallel with the axis of the camshaft and being formed with a plurality of fine passages which pass through the partition wall;

a plurality of projection walls projecting from a part of the inner surface of the cylinder head cover which faces the valve operating chamber through the opening, the projection walls projecting toward the valve operating chamber and extending in the second direction, the projection walls being located separate from each other, and a partition wall projecting from the inner surface of the cylinder head cover toward the separator cover, the partition wall having a lower end separate from the separator cover to form a slit-like gas inlet.

2. An oil separator as claimed in claim 1, wherein the projections walls and the opening of the separator cover are located above the camshaft.

3. An oil separator as claimed in claim 1, wherein the part of the inner surface of the cylinder head cover is inclined in a manner that a level of the part rises in a direction toward the inlet-side separator chamber.

4. An oil separator as claimed in claim 1, wherein the separator cover has an inlet chamber bottom wall defining the inlet chamber, located between the opening of the separator cover and the slit-like gas inlet, the inlet chamber bottom wall inclining in a manner that a first portion is lower in level than a second portion, the first portion being adjacent the opening, the second portion being adjacent the slit-like gas inlet.

5. An oil separator as claimed in claim 4, wherein the separator cover has a step portion located between the inlet chamber bottom wall and the slit-like gas inlet so that the slit-like gas inlet is located higher in level than the inlet chamber bottom wall.

6. An oil separator as claimed in claim 1, wherein the separator cover is a molded member formed of plastic, wherein the cylinder head cover is a molded member formed of plastic.

7. An oil separator as claimed in claim 1, wherein the separator cover is welded to the cylinder head cover.

* * * * *